US008784225B2

(12) United States Patent
Burns et al.

(10) Patent No.: US 8,784,225 B2
(45) Date of Patent: Jul. 22, 2014

(54) COLLAPSIBLE INFANT SUPPORT DEVICE

(75) Inventors: Stephen Burns, Cumming, GA (US); Alex Soriano, Atlanta, GA (US); John Matthew Thomson, Johns Creek, GA (US)

(73) Assignee: Kids II, Inc., Atlanta, GA (US)

( * ) Notice: Subject to any disclaimer, the term of this patent is extended or adjusted under 35 U.S.C. 154(b) by 103 days.

(21) Appl. No.: 13/542,862

(22) Filed: Jul. 6, 2012

(65) Prior Publication Data

US 2013/0012329 A1 Jan. 10, 2013

Related U.S. Application Data

(60) Provisional application No. 61/505,585, filed on Jul. 8, 2011.

(51) Int. Cl.
*A63G 9/00* (2006.01)
*A47D 1/02* (2006.01)

(52) U.S. Cl.
USPC ..... 472/118; 297/16.1

(58) Field of Classification Search
USPC ..... 472/118–125; 273/16.1, 19, 50; 5/101, 5/102; 297/16.1, 19, 50
See application file for complete search history.

(56) References Cited

U.S. PATENT DOCUMENTS

| | | | | |
|---|---|---|---|---|
| 5,238,291 | A | 8/1993 | Alionis | |
| 5,617,594 | A * | 4/1997 | Chien | 5/102 |
| 5,707,104 | A * | 1/1998 | Perego | 297/16.1 |
| 6,520,862 | B1 | 2/2003 | Armbruster et al. | |
| 6,692,368 | B1 * | 2/2004 | Hyun | 472/119 |
| 6,702,685 | B2 | 3/2004 | Mahlstedt et al. | |
| 6,824,472 | B2 | 11/2004 | Armbruster et al. | |
| 6,857,966 | B2 | 2/2005 | Armbruster et al. | |
| 6,872,146 | B1 | 3/2005 | Paesang et al. | |
| 6,887,161 | B2 | 5/2005 | Mahlstedt et al. | |
| 6,896,624 | B2 | 5/2005 | Longenecker et al. | |
| 7,052,403 | B2 | 5/2006 | Ransil et al. | |
| 7,081,052 | B2 | 7/2006 | Greger et al. | |
| 7,189,164 | B1 | 3/2007 | Paesang et al. | |
| 7,354,352 | B2 | 4/2008 | Keska et al. | |
| 7,445,559 | B2 | 11/2008 | Kakuda | |
| 7,789,762 | B2 | 9/2010 | Greger et al. | |
| 2005/0143181 | A1 | 6/2005 | Armbruster et al. | |

* cited by examiner

*Primary Examiner* — Kien Nguyen

(74) *Attorney, Agent, or Firm* — Gardner Groff Greenwald & Villanueva, PC

(57) ABSTRACT

A collapsible, portable infant swing having a foldable base movable between an unfolded, extended position and a folded, collapsed position, a lock mechanism for selectively locking/unlocking the foldable base, and support arms supported by the foldable base. Swing arms are pivotally coupled to the support arms for pivotal, back and forth motion and an infant support seat coupled to the swing arms for supporting and swinging an infant. A multi-function handle is provided for housing the lock mechanism for locking/unlocking the foldable base, for grasping the foldable base to fold the foldable base, and for carrying the swing when the foldable base is folded. The multi-function handle is positioned substantially centrally below the seat to make it generally inaccessible by the infant.

23 Claims, 9 Drawing Sheets

COLLAPSIBLE INFANT SUPPORT DEVICE

CROSS-REFERENCE TO RELATED APPLICATIONS

This application claims the benefit of U.S. Provisional Patent Application Ser. No. 61/505,585 filed Jul. 8, 2011, the entirety of which is hereby incorporated herein by reference for all purposes.

TECHNICAL FIELD

The present invention relates generally to the field of infant support devices, and more particularly to collapsible, portable infant support devices, such as a portable swing for example.

BACKGROUND

Infant support devices are well-documented in the prior art and generally include swings, rockers, bouncers, cribs, cradles, high chairs, bassinets, entertainers, etc. In general, these products are typically defined by an infant seat coupled to a support frame. Recent prior art has shown infant support devices which are configured to collapse for storage and/or portability purposes.

Typically, collapsible infant support devices include a locking mechanism located on an upright portion of the frame and which requires minimal effort to release. Thus, a child can easily access the locking mechanism while in the seat and may accidentally collapse the support device or pinch their fingers in the locking mechanism. This location also subjects the locking mechanism to tension and it is often found that the locking mechanism fails or wears down over time.

Furthermore, in the collapsed configuration, infant support devices are typically awkward for a caregiver to manually transport. Typically, there is no obvious or convenient way of picking up and/or carrying the support device, so it is common that the support device is grabbed or held by a caregiver in a way that can cause injury or the accidental unfolding of the support device.

SUMMARY

The present invention is directed to the field of infant support devices, and more particularly to a collapsible and portable infant support device. In a first aspect the present invention relates to a collapsible, portable infant support device comprising a foldable base movable between an unfolded, extended position and a folded, collapsed position. The foldable base has a lock mechanism for locking/unlocking the foldable base and one or more support arms supported by the foldable base. A multi-function handle is provided and for housing and/or operating the lock mechanism for locking/unlocking the foldable base, for grasping the foldable base to fold the foldable base, and for carrying the device when the foldable base is folded. This greatly improves the ease of using and transporting the device.

Preferably, the device is an infant swing and one or more swing arms are pivotally coupled to the support arms for pivotal, back and forth motion. In such an embodiment, an infant support seat is coupled to the swing arms for supporting and swinging an infant. Preferably, with the foldable base in its unfolded, extended position the lock mechanism is positioned substantially beneath the infant support seat. Preferably, with the foldable base in its unfolded, extended position the lock mechanism is positioned substantially centrally beneath the infant support seat. Preferably, with the foldable base in its unfolded, extended position and with an infant in the infant support seat the lock mechanism is positioned in such a location to make it inaccessible to the infant while the infant is positioned in the infant support seat. By making the lock inaccessible to the infant in the seat, the child is better protected against injury from interacting with the lock.

Optionally, the multi-function handle includes a finger opening and a squeezable button for unlocking the lock mechanism. Also optionally, with the foldable base in its folded, collapsed position and the swing being carried by the handle, the handle is positioned above a center of gravity of the collapsible, portable infant swing.

The lock mechanism can include a pair of optional retractable bolts for capturing and releasing a portion of the foldable base. Also, the swing can be a power swing powered by electromagnets.

In another aspect, the present invention relates to a collapsible, portable infant swing having a foldable base movable between an unfolded, extended position and a folded, collapsed position. The foldable base comprises a lock mechanism for locking/unlocking the foldable base and one or more support arms that are supported by the foldable base. One or more swing arms are pivotally coupled to the support arms for pivotal, back and forth motion and an infant support seat is coupled to the swing arms for supporting and swinging an infant. With the foldable base in its unfolded, extended position the lock mechanism is located substantially beneath the infant support seat so as to protect the infant from engaging or otherwise contacting the lock mechanism while the infant is in the seat. By making the lock inaccessible to the infant in the seat, the risk of injury from interacting with the lock is reduced.

Optionally, a multi-function handle is provided and for housing the lock mechanism for locking/unlocking the foldable base, for grasping the foldable base to fold the foldable base, and for carrying the swing when the foldable base is folded. This greatly improves the ease of using and transporting the device.

Preferably, with the foldable base in its unfolded, extended position the lock mechanism is located substantially centrally beneath the infant support seat. Preferably, the lock mechanism is located in such a position to make it inaccessible to the infant while the infant is positioned in the infant support seat.

Optionally, the lock mechanism includes a pair of retractable bolts for capturing and releasing a portion of the foldable base. Also optionally, with the foldable base in its folded, collapsed position and the swing being carried by the handle, the handle is positioned above a center of gravity of the collapsible, portable infant swing.

Notably, the present invention can take the form of any of a variety of infant support devices, including swings, bouncers, high chairs, cradles, entertainers, bassinets, rockers, cribs, etc. Additionally, the locking mechanism can be configured as any of a variety of conventional locking means, including but not limited to a spring biased latch, a slidable latch, clamping means, clipping means, etc. Moreover, the particular exemplary configurations, suggested materials of construction, and objectives described herein are merely exemplary and are in no way limiting.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
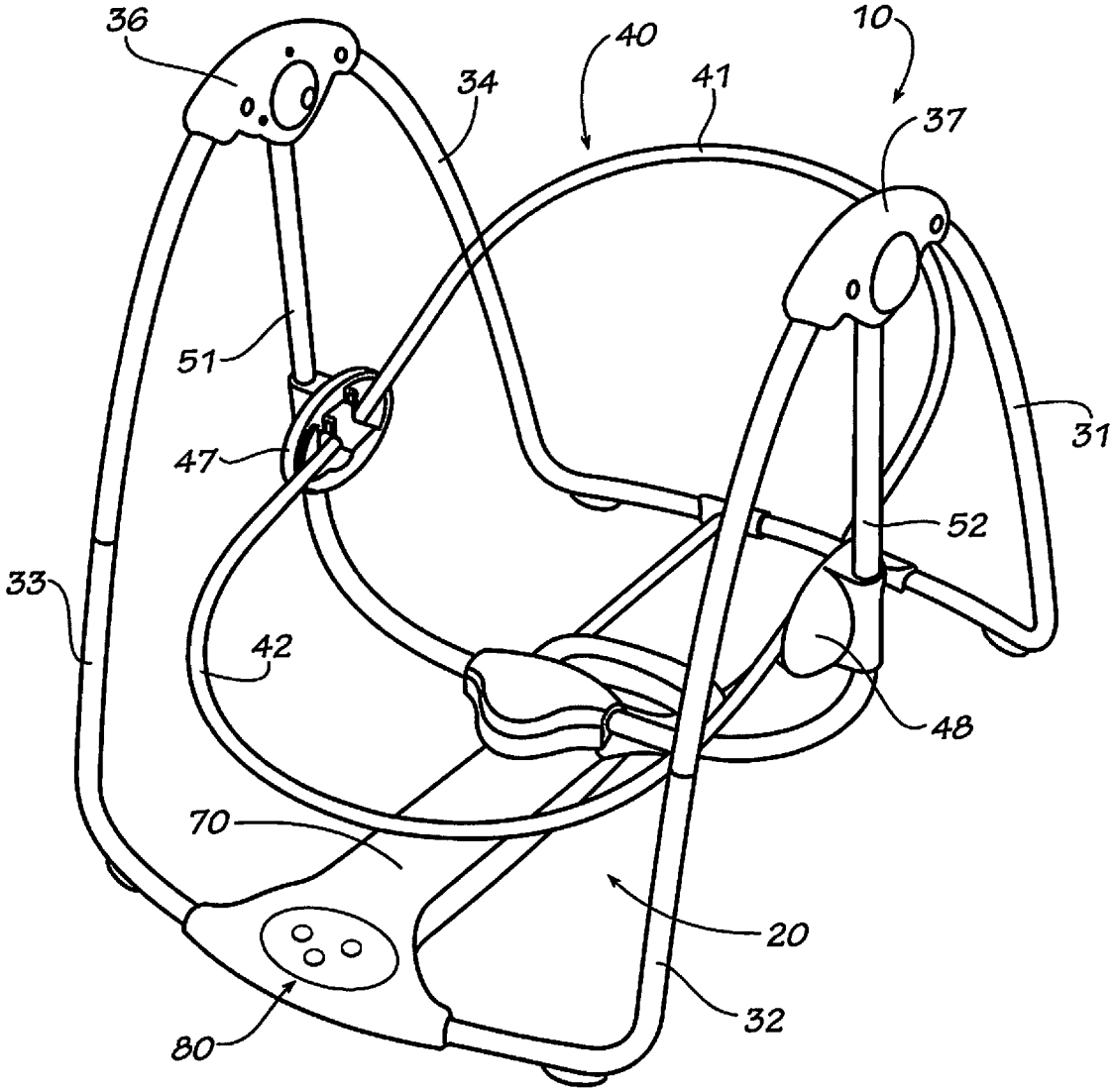
FIG. 1 is a perspective view of an infant swing device according to an example embodiment of the present invention and shown with a seat pad portion thereof omitted to better illustrate the framework.

With reference now to the drawing figures, wherein like reference numbers represent corresponding parts throughout the several views, FIG. 1 shows an infant support device of the present invention, according to an example embodiment. The infant support device in this example is an infant swing (10) that includes a base frame (20), a plurality of leg members (31-34) coupled to and extending upward from the base frame (20), and a seat frame (40) pivotally coupled to the leg members (31-34) by a plurality of swing arms (51, 52). The swing (10) is convertible between an erect, operable position and a collapsed, inoperable position. The base frame (20) includes a locking mechanism (60—best shown in FIG. 2) which secures the swing (10) in the erect configuration. When the locking mechanism (60) is released by a caregiver, the swing (10) can be converted to the collapsed configuration. The base frame (20) also includes a multi-function handle device (70) which a caregiver may grasp when manually transporting the swing (10) in the collapsed configuration. The example device preferably is a magnetic powered swing, with internal (concealed) magnets. Such magnets could be permanent magnets or electromagnets or a combination thereof. The device likewise can be non-powered or can be powered by one or more conventional motors. Further, user-selectable controls (80), such as, for example, speed control, volume control, a timer, etc., are located on the base frame (20), such that a caregiver may operate the swing (10) with their feet. This leaves the hands of the caregiver free to attend to the infant and allows the caregiver to avoid the strain of bending forward.

According to alternative embodiments, the swing (10) may include more or less than the illustrated two swing arms (51, 52). Further, the support device may instead be configured as a cradle, high chair, entertainer, bassinet, bouncer, rocker, crib, or similar device.

Figure 2B:
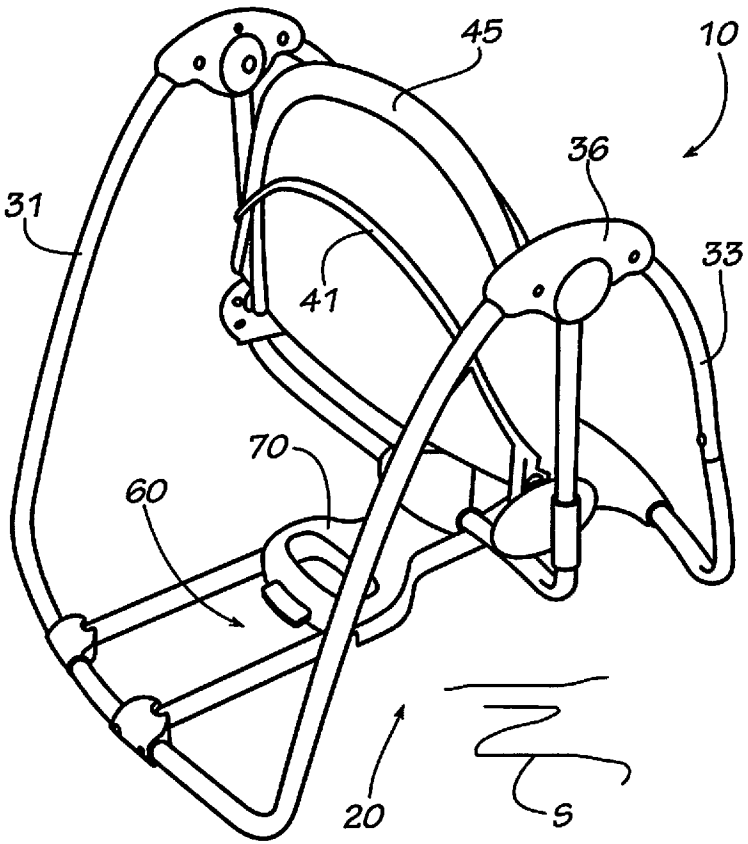
FIG. 2B is a perspective view of the infant swing device of FIG. 2A, showing the seat portion thereof folded.
Figure 2A:
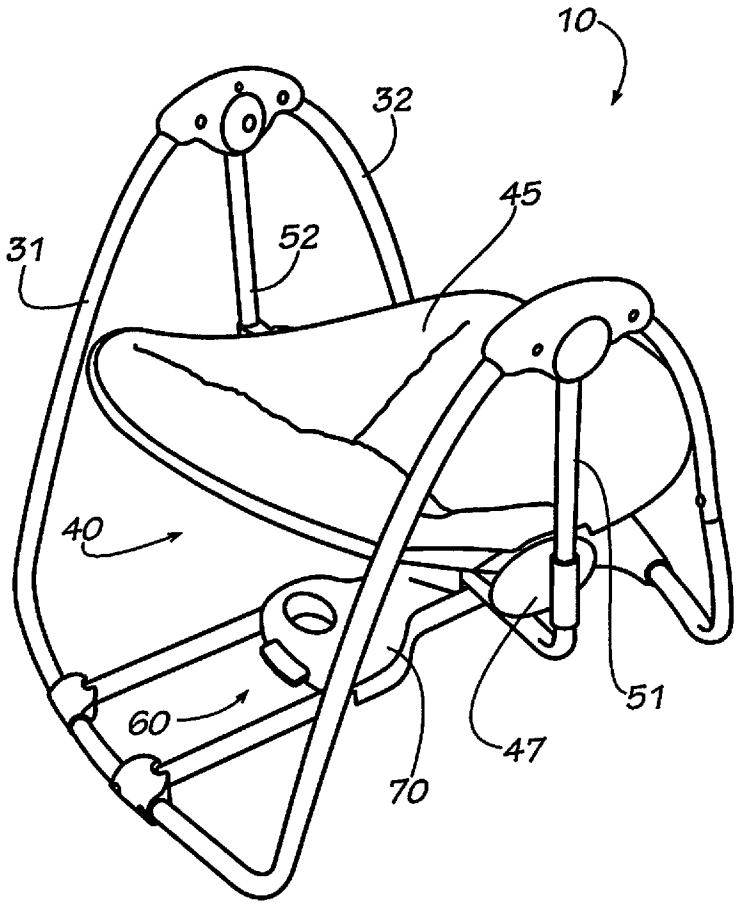
FIG. 2A is a perspective view of the infant swing device of FIG. 1, shown with a seat pad installed.

FIG. 2A illustrates the first step in collapsing the infant swing device (10), according to an example embodiment. As illustrated, the seat frame (40) comprises a generally C-shaped front portion (41) and a generally C-shaped rear portion (42). Each of the C-shaped portions include a first end and a second end, with the first and second ends of the front portion (41) being pivotally coupled to first and second ends of the rear portion (42), respectively, at first and second seat frame hubs (47,48). The seat frame (40) is also configured to support an infant-receiving seat pad (45).

Step one of the collapsing process involves pivoting the front portion (41) and rear portion (42) of the seat frame (40) towards each other, such that the collapsed seat frame (40) is aligned with a plane generally perpendicular to the ground surface (S), as shown in FIG. 2B. Upon collapsing the seat frame (40), the caregiver can now easily access the locking mechanism (60) positioned on the base frame (20), as shown in FIG. 2B. According to alternative embodiments, there may be additional locking mechanisms which can act as a redundant safety feature. Additionally, the locking mechanism (60) may employ any conventional locking means, such as a spring biased latch, a slidable latch, clamping means, clipping means, or other similar device. Furthermore, alternative embodiments of the seat frame (40) may not be configured to collapse or may be configured to alternatively collapse, such as, for example, the seat frame (40) may pivot as a whole to a more vertical orientation. Moreover, the seat frame (40) is not limited to the generally ovular shape represented herein and further, the seat frame (40) may be replaced with a shell (bucket) seat or other conventional seating means. Finally, the seat frame (40) may be selectively positionable in a plurality of seat-facing orientations.

Figure 3B:
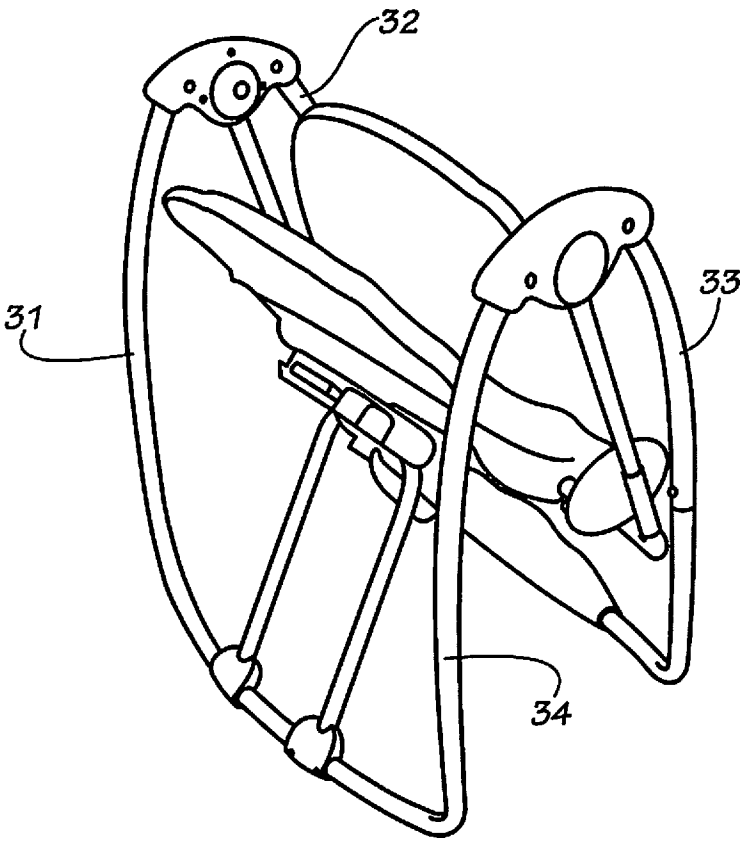
FIG. 3B is a perspective view of the infant swing device of FIG. 2A, showing the base portion thereof partly folded.
Figure 3A:
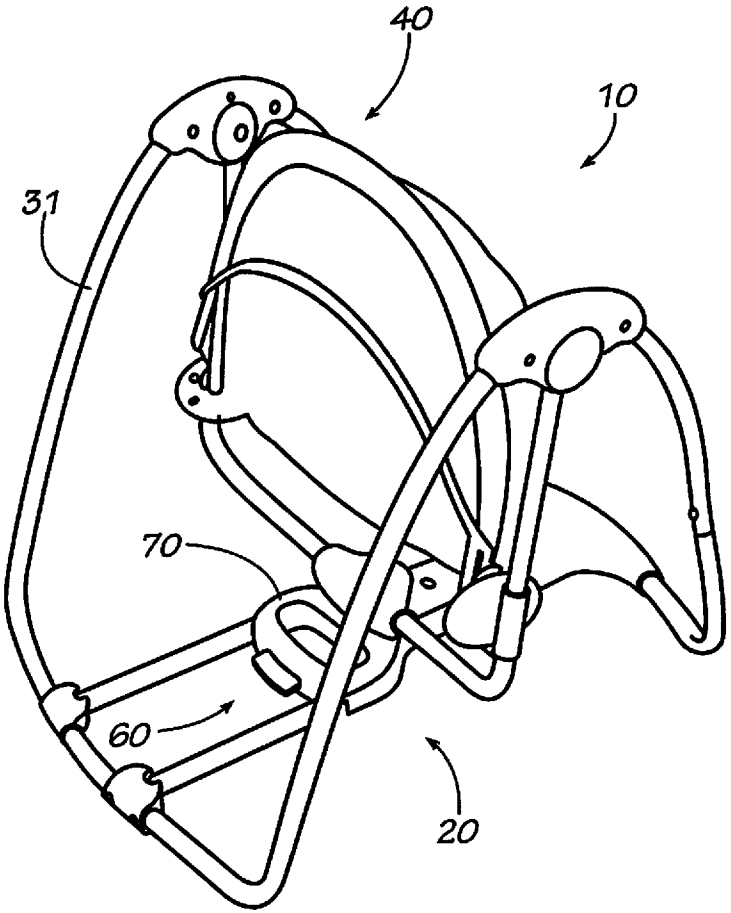
FIG. 3A is a perspective view of the infant swing device of FIG. 2A, showing the seat portion thereof folded and the user grasping a locking mechanism.
Figure 4:
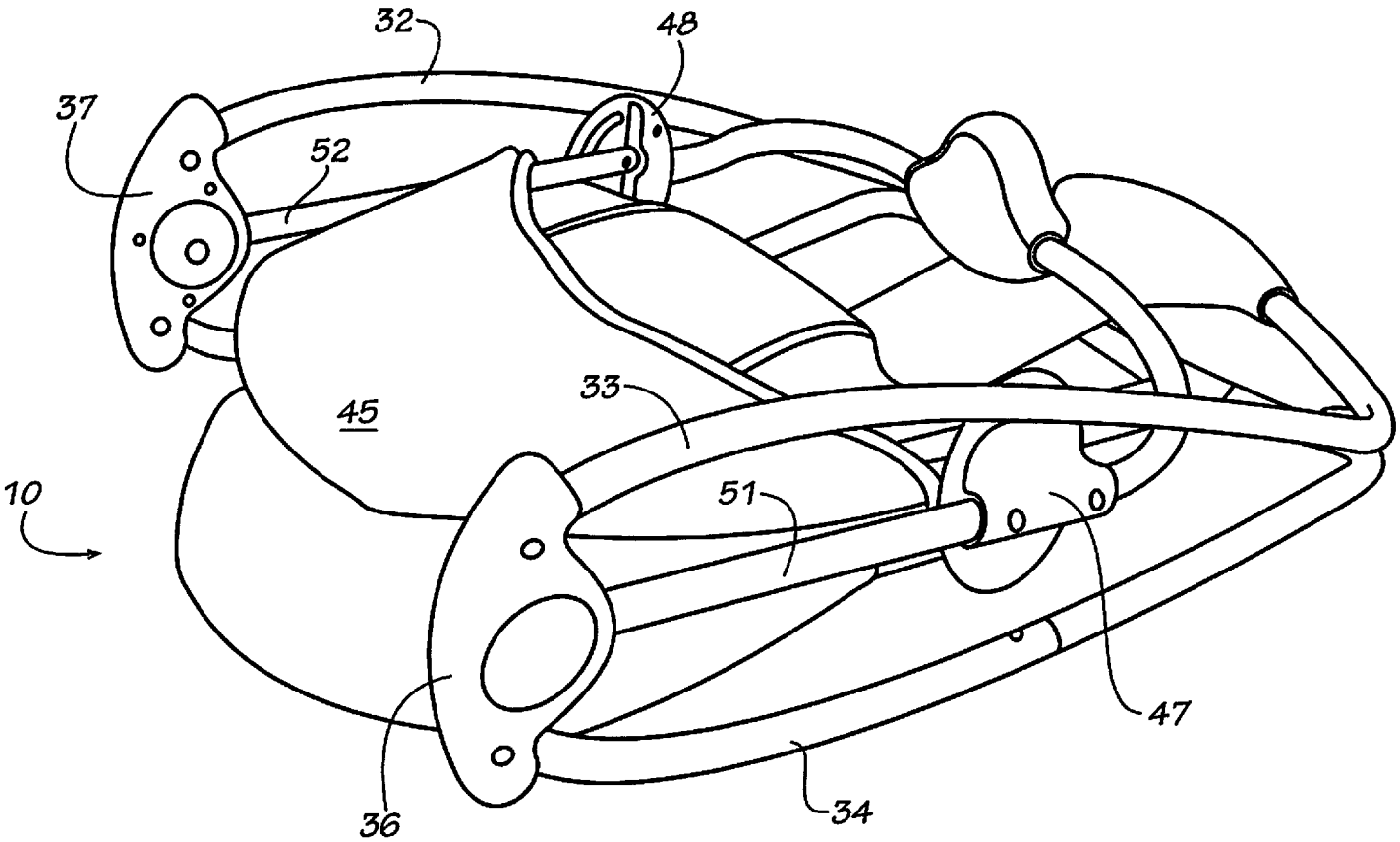
FIG. 4 is a perspective view of the infant swing device of FIG. 2A, showing the swing folded into a compacted, folded configuration.

FIG. 3A illustrates the second and final step in collapsing the infant swing (10), according to an example embodiment. As shown, the caregiver grasps the multi-function handle device (70) formed in the base frame (20) and releases the locking mechanism (60) positioned thereat. The base frame (20) is configured so that as the caregiver pulls upwardly on the multi-function handle device (70), the base frame (20) pivots upwardly into a generally vertical orientation, adjacent to the collapsed seat frame (40). As a result, the leg members (31-34) are pulled inwardly towards a more vertical orientation (see FIG. 3B, in which the leg members are nearly vertical and the swing is almost fully folded). Thus, as shown in FIG. 4, the collapsed swing (10) occupies minimal volume and can be propped against a wall or stowed in a closet. Although the present embodiment illustrates the locking mechanism (60) and multi-function handle device (70) coupled to one another, the locking mechanism (60) and multi-function handle device (70) may be positioned at spaced apart locations on the base frame (20) or elsewhere, according to alternative embodiments. Furthermore, the base frame (20) and leg members (31-34) may be configured to collapse differently than the method described herein.

As shown in FIG. 4, the collapsed swing (10) can also be positioned horizontally in order to occupy minimal vertical space, and thus can be slid underneath a couch or bed, or can be placed in the trunk of a car.

Figure 5:
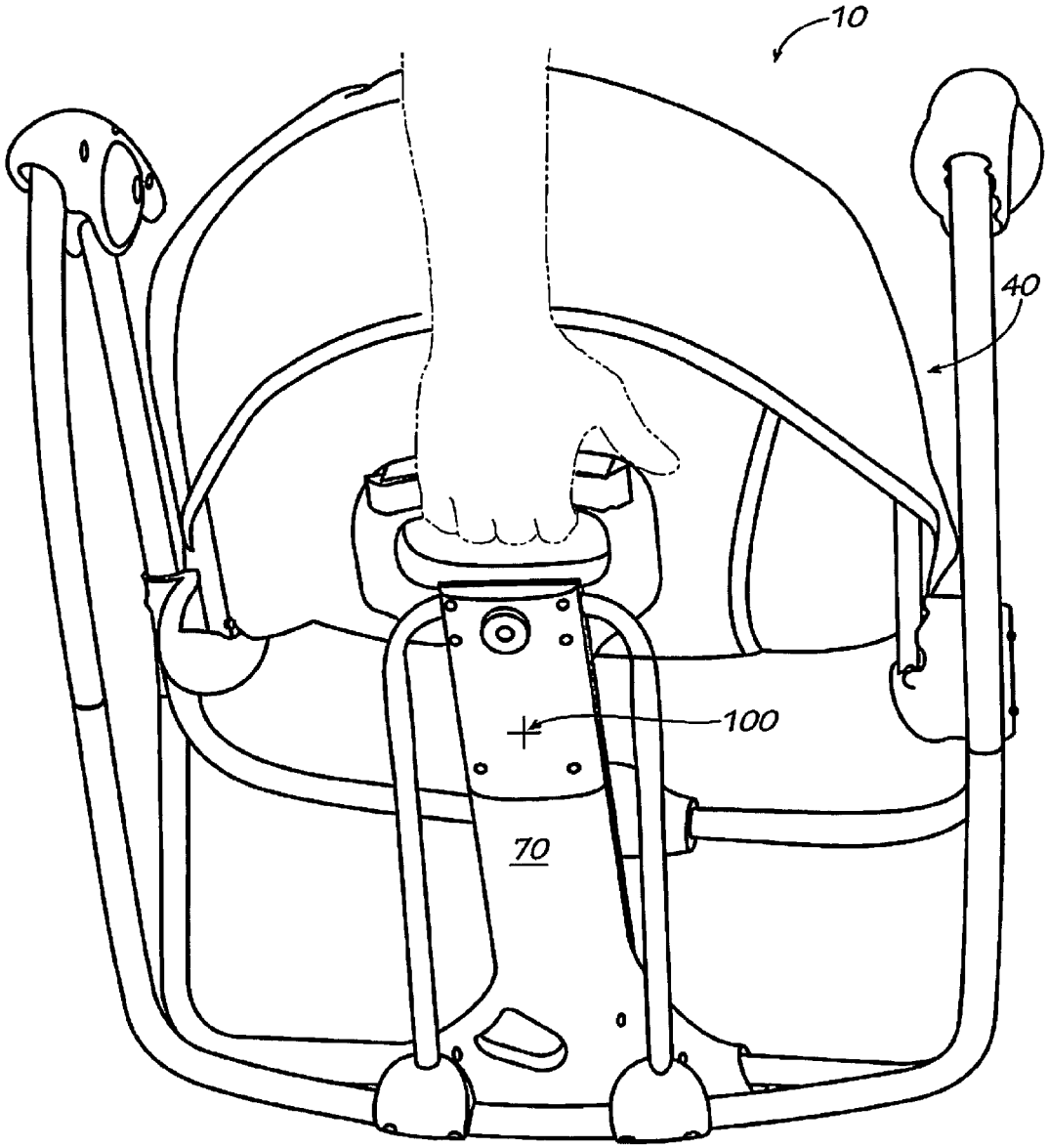
FIG. 5 is a perspective view of the infant swing device of FIG. 2A, showing the swing folded and being transported by a user.

FIG. 5 illustrates a caregiver manually transporting the infant swing device (10) by utilizing the multi-function handle device (70) formed in the base frame (20), according to an example embodiment. As shown the caregiver grasps the multi-function handle device (70) and holds the swing (10) such that the collapsed seat frame (40) is positioned between the body of the caregiver and the handle device (70). Thus, the swing (10) is prevented from unfolding during transportation. According to alternative embodiments of the support device, any of the seat frame (40), base frame (20), or leg members (31-34) may include a securing device, such as, for example, a latch, lock, tie, snap, or other similar device, which is configured to retain the support device in the collapsed configuration. Also, by having the multi-function handle (70) located to one side of the center of gravity (100) of the folded device, the device can be carried in a stable manner. In this regard, the location of the multi-function handle (70) is above the center of gravity (100) so that the folded device stably hangs therefrom as the user grasps and carries the folded device by the multi-function handle (see FIG. 5).

Figure 6:
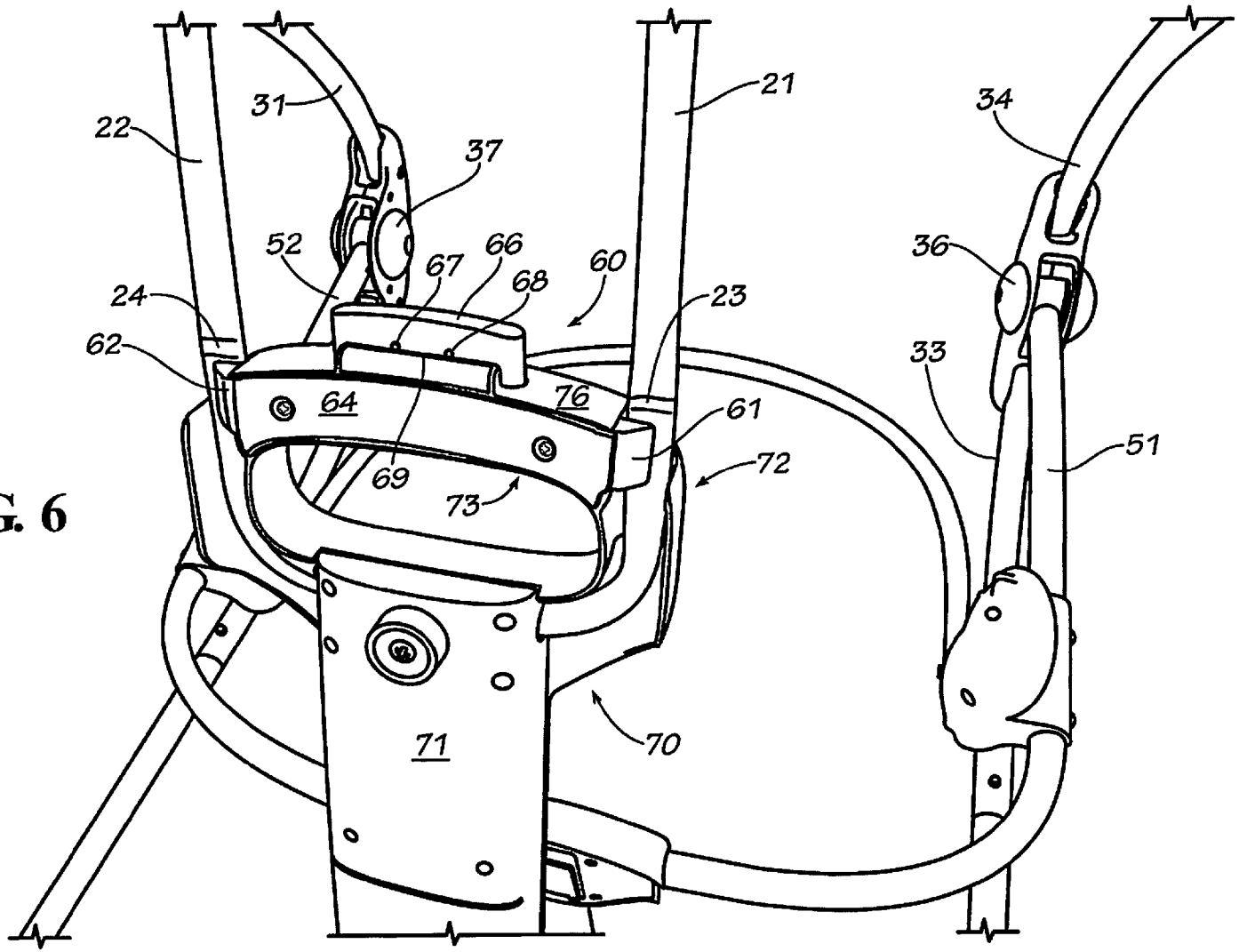
FIG. 6 is a perspective bottom view of a lock mechanism portion and base portion of the infant swing of FIG. 1, with the base portion shown in a locked, extended position.

As seen beginning with FIG. 6, the multi-function handle (70) includes an elongate portion (71) which is connected to and forms part of the base frame (20). At one end of the multi-function handle (70), a handgrip indicated generally at (72) is formed. The handgrip includes a finger opening (73) through which one can insert several fingers for grasping the multi-function handle (70). Base legs (21, 22) are pivotally attached to the multi-function handle (70) and are releasably secured in locked and unlocked positions by the locking mechanism (60). The locking mechanism (60) is substantially housed in the multi-function handle (70) and is substantially covered by a lock cover (64) secured by screws. As will be seen below, the locking mechanism (60) is operated by grasping the multi-function handle (70) and squeezing, thereby depressing a button portion of the locking mechanism.

Locking mechanism (60) includes a pair of retractable lock bolts with beveled edges, such as retractable lock bolts (61, 62). As shown in FIG. 6, with the retractable lock bolts (61) and (62) in their extended positions, the base legs (21, 22) can be secured in the unfolded, flat configuration shown. In this regard, the base legs (21, 22) have optional flat portions or flats (23, 24) formed in/on the base legs (21, 22) for engaging the flat surface of the lock bolts (61, 62). These flats can be formed in the base legs (21, 22) by crimping, swaging or any number of processes. However, the flats can be omitted, as desired. The locking mechanism (60) further includes a lock button (66) which extends through an end surface (76) of the multi-function handle (70). The lock button (66) can be squeezed by one's palm or one or more fingers and forced inwardly into the multi-function handle, thereby retracting the retractable lock bolts (61, 62), as will be explained in further detail subsequently.

Guide slots (67, 68) are formed in the underside of the lock button (66) for helping to guide the lock button for translational, back and forth movement. In this regard, unshown pins in the lock mechanism and/or multi-function handle ride in the slots (67, 68) to assist in this guiding function. Additional guiding is provided by guide element (69).

Figure 6A:
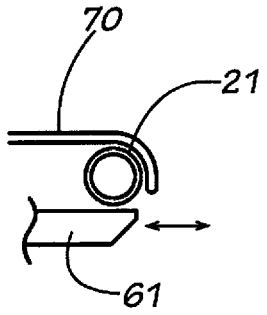
FIG. 6A is a sectional view of the lock mechanism portion of the infant swing of FIG. 6.

As shown in FIG. 6A, the fore and aft movement of the retractable bolts, such as retractable bolts (61, 62), release and/or capture the base legs, such as base legs (21, 22); within the end of the multi-function handle (70).

Figure 7:
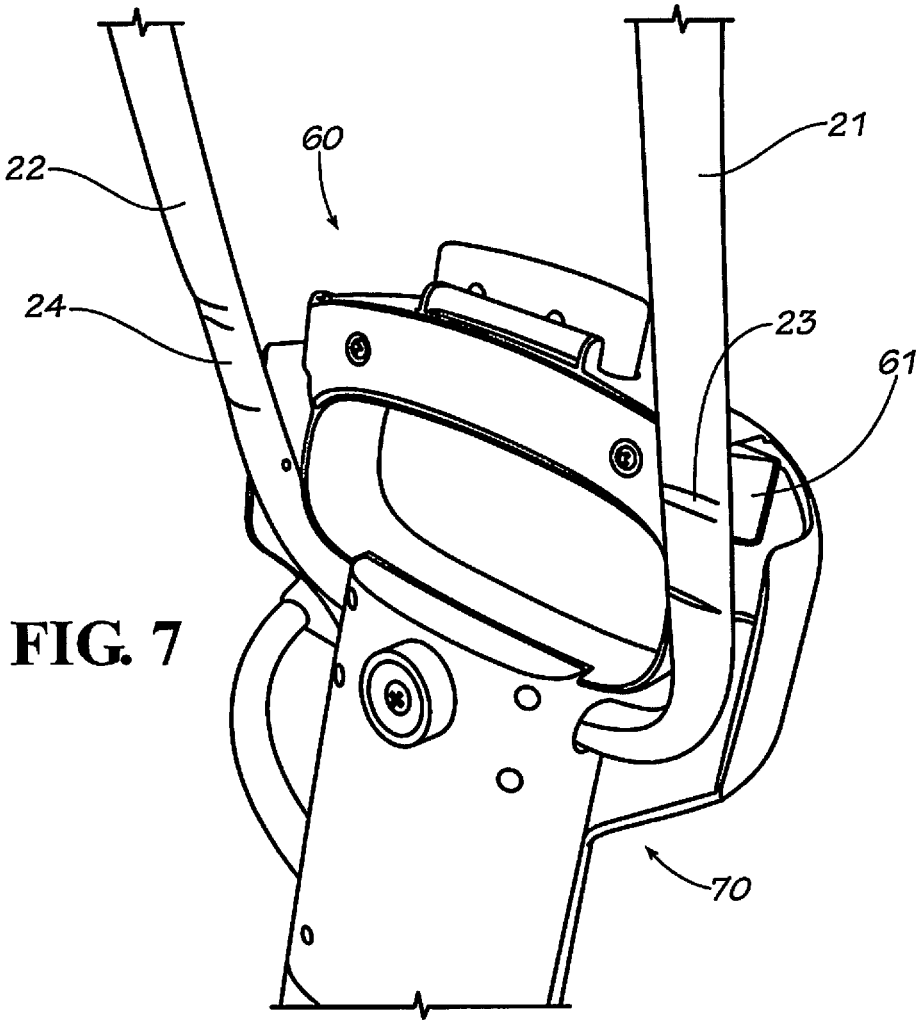
FIG. 7 is a bottom perspective view of the lock mechanism and base portion of the infant swing of FIG. 6, shown in an unlocked and partly folded position.

FIG. 7 shows the base legs (21, 22) released from capture by the lock mechanism (60), such that the base legs (21, 22) can be pivoted away from the lock mechanism or toward the lock mechanism, such as for folding or unfolding the base.

Figure 8A:
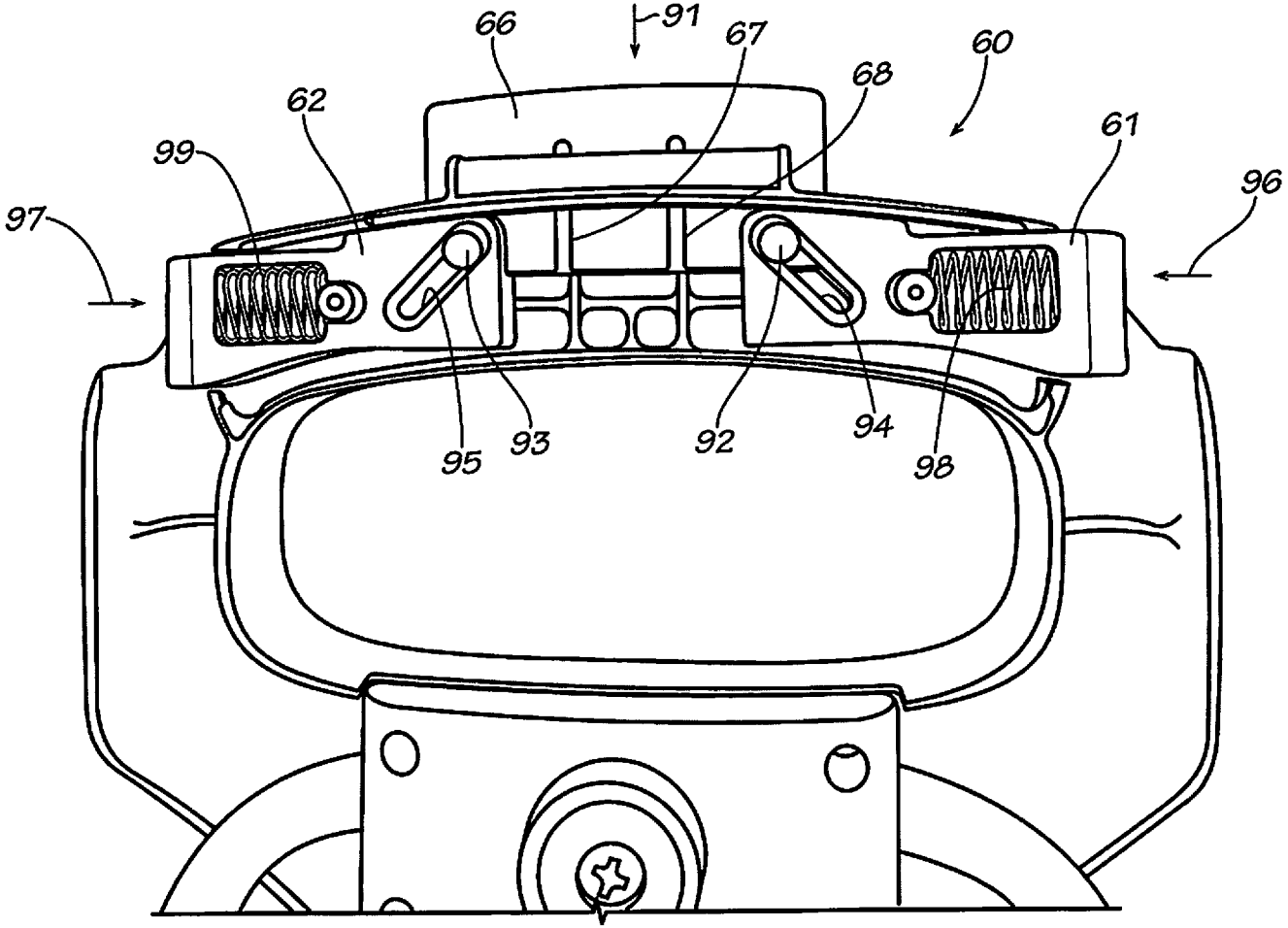
FIG. 8A is a bottom perspective view of the lock mechanism of FIG. 6, shown with a cover portion thereof removed.

FIG. 8A shows the lock mechanism (60) in greater detail, with the lock cover (64) of FIG. 6 removed for clarity of illustration. As can be appreciated from this drawing, as the lock button (66) is depressed inwardly in the direction of direction arrow (91), the lock button (66) is guided by the guide slots (67, 68) with the cooperating, unshown guide pins. Cam pins (92, 93) extend from the underside of the lock button (66) for converting movement of the lock button into movement of the retractable bolts. Movement of the lock button (66) in the direction of direction arrow (91) causes these cam pins (92, 93) to move in a similar direction. As these pins ride in their corresponding cam slots (94, 95), movement of the lock button (66) in the direction of direction arrow (91) causes a corresponding movement of the retractable bolts (61, 62) in the direction of direction arrows (96, 97). Similarly, releasing the lock button (66) causes the reverse motion, opposite to direction arrow (91) which causes then the retractable bolts (61, 62) to extend outwardly, opposite to direction arrows (96, 97).

Figure 8B:
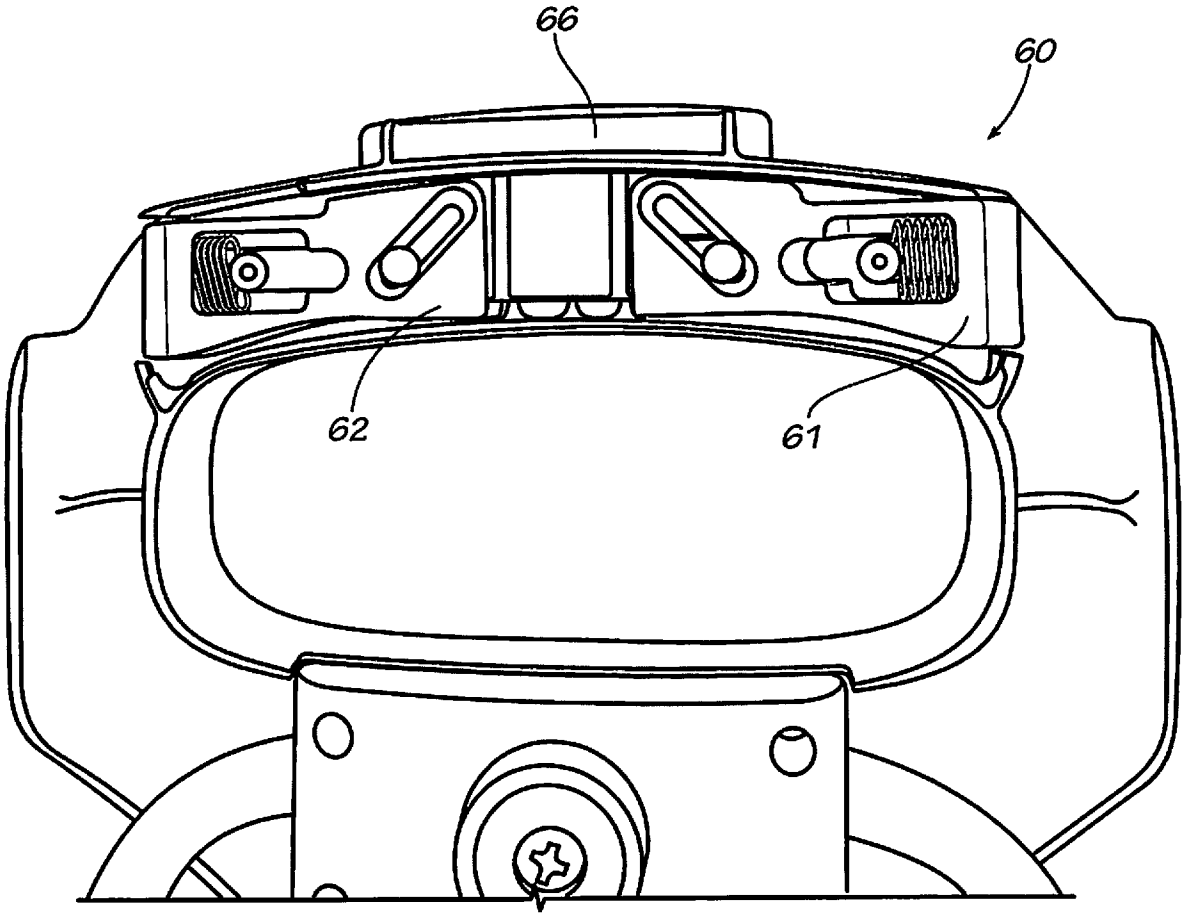
FIG. 8B is a bottom perspective view of the lock mechanism of FIG. 6, shown with a cover portion thereof removed and with lock bolt portions of the lock mechanism retracted.

To bias the lock bolts (61, 62) toward the outward, extended position, and to bias the lock button (66) towards an extended position, a pair of compression springs (98, 99) are provided. These compression springs (98, 99) operate on fixed pins and tend to push the lock bolts outwardly. Those skilled in the art will recognize that other biasing means can be employed, as desired. FIG. 8A shows the lock mechanism (60) with the lock bolts in their extended positions, while FIG. 8B shows the lock mechanism (60) with the lock button (66) depressed and the retractable lock bolts (61, 62) retracted.

By positioning the lock mechanism substantially beneath (nearly centrally beneath) the seat, the infant is substantially prevented from contacting the lock mechanism while in the seat. This greatly improves the safety for the infant. Moreover, by moving the lock mechanism from the upright arms (as in the prior art) to underneath the seat the safety of the infant is greatly improved, both in terms of avoiding finger pinches and avoiding triggering the locking mechanism while the infant is in/on the seat. Positioning the locking mechanism in a substantially central location beneath the seat adds to this safety feature. This protects the infant against engaging the locking mechanism, and also protects against a sibling or caregiver from engaging the locking mechanism while an infant is seated upon the seat, by making it difficult to access the locking mechanism without first removing the infant from the seat. Thus, safety of the device is improved generally.

In one aspect the present invention relates to a collapsible, portable infant support device comprising a foldable base (20) movable between an unfolded, extended position and a folded, collapsed position. The foldable base (20) has a lock mechanism (60) for locking/unlocking the foldable base and support arms (31, 32) supported by the foldable base (20). A multi-function handle (70) is provided and is operable for operating the lock mechanism for locking/unlocking the foldable base, for grasping the foldable base to fold the foldable base, and for carrying the device when the foldable base is folded. This greatly improves the ease of using and transporting the device.

Preferably, the device is an infant swing (10) and swing arms (51, 52) are pivotally coupled to the support arms (31, 32) for pivotal, back and forth motion. In such an embodiment, an infant support seat (40, 45) is coupled to the swing arms (51, 52) for supporting and swinging an infant. Preferably, with the foldable base (20) in its unfolded, extended position the lock mechanism (60) is positioned substantially beneath the infant support seat. Preferably, with the foldable base in its unfolded, extended position, the lock mechanism is positioned substantially centrally beneath the infant support seat. Preferably, with the foldable base in its unfolded, extended position and with an infant in the infant support seat the lock mechanism is positioned in such a location to make it inaccessible to the infant while the infant is positioned in the infant support seat. By making the lock inaccessible to the infant in the seat, the child is safer against injury from interacting with the lock.

While the invention has been described with reference to preferred and example embodiments, it will be understood by those skilled in the art that a variety of modifications, additions and deletions are within the scope of the invention, as defined by the following claims.

What is claimed is:

1. A collapsible, portable infant swing comprising:

a foldable base movable between an unfolded, extended position and a folded, collapsed position, and wherein the foldable base comprises a lock mechanism for selectively locking/unlocking the foldable base;

one or more support arms supported by the foldable base;

one or more swing arms pivotally coupled to the support arms for pivotal, back and forth motion;

an infant support seat coupled to the swing arms for supporting and swinging an infant; and a multi-function handle for housing the lock mechanism for selectively locking/unlocking the foldable base, for grasping the foldable base to fold the foldable base, and comprising a handgrip having an opening for carrying the swing when the foldable base is folded.

2. A collapsible, portable infant swing as claimed in claim 1 wherein with the foldable base in its unfolded, extended position, the lock mechanism is positioned substantially beneath the infant support seat.

3. A collapsible, portable infant swing as claimed in claim 1 wherein with the foldable base in its unfolded, extended position, the lock mechanism is positioned substantially centrally beneath the infant support seat.

4. A collapsible, portable infant swing as claimed in claim 1 wherein with the foldable base in its unfolded, extended position and with an infant in the infant support seat, the lock mechanism is positioned in such a location to make it inaccessible to the infant while the infant is positioned in the infant support seat.

5. A collapsible, portable infant swing as claimed in claim 1 wherein the multi-function handle includes a finger opening and a squeezable button for unlocking the lock mechanism.

6. A collapsible, portable infant swing as claimed in claim 5 wherein with the foldable base in its folded, collapsed position and the swing being carried by the handle, the handle is positioned above a center of gravity of the collapsible, portable infant swing.

7. A collapsible, portable infant swing as claimed in claim 1 wherein the lock mechanism includes a pair of retractable bolts for capturing and releasing a portion of the foldable base.

8. A collapsible, portable infant swing as claimed in claim 1 wherein the swing is powered by electromagnets.

9. A collapsible, portable infant support device comprising:

a foldable base movable between an unfolded, extended position and a folded, collapsed position, and wherein the foldable base comprises a lock mechanism for locking/unlocking the foldable base;

one or more support arms supported by the foldable base;

an infant support seat for supporting an infant; and a multi-function handle for housing the lock mechanism for locking/unlocking the foldable base, for grasping the foldable base to fold the foldable base, and comprising a handgrip having an opening for carrying the infant support device when the foldable base is folded.

10. A collapsible, portable infant support device as claimed in claim 9 wherein with the foldable base in its unfolded, extended position, the lock mechanism is positioned substantially beneath the infant support seat.

11. A collapsible, portable infant support device as claimed in claim 9 wherein with the foldable base in its unfolded, extended position, the lock mechanism is positioned substantially centrally beneath the infant support seat.

12. A collapsible, portable infant support device as claimed in claim 9 wherein with the foldable base in its unfolded, extended position and with an infant in the infant support seat the lock mechanism is positioned in such a location to make it inaccessible to the infant while the infant is positioned in the infant support seat.

13. A collapsible, portable infant support device as claimed in claim 9 wherein with the foldable base in its folded, collapsed position and the device being carried by the handle, the handle is positioned above a center of gravity of the collapsible, portable infant support device.

14. A collapsible, portable infant support device as claimed in claim 9 wherein the device comprises an electromagnetic infant swing.

15. A collapsible, portable infant swing comprising:

a foldable base movable between an unfolded, extended position and a folded, collapsed position, and wherein the foldable base comprises a lock mechanism for selectively locking/unlocking the foldable base;

one or more support arms supported by the foldable base;

one or more swing arms pivotally coupled to the support arms for pivotal, back and forth motion;

an infant support seat coupled to the swing arms for supporting and swinging an infant; and wherein with the foldable base in its unfolded, extended position the lock mechanism is located substantially centrally beneath the infant support seat.

16. A collapsible, portable infant swing as claimed in claim 15 further comprising a multi-function handle for housing the lock mechanism for selectively locking/unlocking the foldable base, for grasping the foldable base to fold the foldable base, and for carrying the swing when the foldable base is folded.

17. A collapsible, portable infant swing as claimed in claim 16 wherein with the foldable base in its folded, collapsed position and the swing being carried by the handle, the handle is positioned above a center of gravity of the collapsible, portable infant swing.

18. A collapsible, portable infant swing as claimed in claim 15 wherein with the foldable base in its unfolded, extended position and with an infant in the infant support seat, the lock mechanism is positioned in such a position to make it inaccessible to the infant while the infant is positioned in the infant support seat.

19. A collapsible, portable infant swing as claimed in claim 15 wherein the lock mechanism includes a pair of retractable bolts for capturing and releasing a portion of the foldable base.

20. A collapsible, portable infant support device comprising:

a foldable base movable between an unfolded, extended position and a folded, collapsed position, and wherein the foldable base comprises a lock mechanism for selectively locking/unlocking the foldable base;

one or more support arms supported by the foldable base;

an infant support seat for supporting an infant; and wherein with the foldable base in its unfolded, extended position the lock mechanism is positioned substantially centrally beneath the infant support seat.

21. A collapsible, portable infant support device as claimed in claim 20 further comprising a multi-function handle for housing the lock mechanism for selectively locking/unlocking the foldable base, for grasping the foldable base to fold the foldable base, and for carrying the infant support device when the foldable base is folded.

22. A collapsible, portable infant support device as claimed in claim 21 wherein with the foldable base in its folded, collapsed position and the device being carried by the handle, the handle is positioned above a center of gravity of the collapsible, portable infant support device.

23. A collapsible, portable infant support device as claimed in claim 20 wherein with the foldable base in its unfolded, extended position and with an infant in the infant support seat the lock mechanism is positioned in such a position to make it inaccessible to the infant while the infant is positioned in the infant support seat.

* * * * *